US007550660B2

(12) United States Patent
Kammerer

(10) Patent No.: US 7,550,660 B2
(45) Date of Patent: Jun. 23, 2009

(54) STRINGED INSTRUMENT CONSTRUCTION

(75) Inventor: Jon David Kammerer, Hamilton, IL (US)

(73) Assignee: Jon Kammerer, Hamilton, IL (US)

( * ) Notice: Subject to any disclaimer, the term of this patent is extended or adjusted under 35 U.S.C. 154(b) by 0 days.

(21) Appl. No.: 11/788,022

(22) Filed: Apr. 19, 2007

(65) Prior Publication Data

US 2008/0257130 A1 Oct. 23, 2008

(51) Int. Cl.
*G10D 3/00* (2006.01)

(52) U.S. Cl. ..... 84/291; 84/267

(58) Field of Classification Search ..... 84/291, 84/173, 290, 267, 298; D17/14, 19, 20, 21, D17/99

See application file for complete search history.

(56) References Cited

U.S. PATENT DOCUMENTS 4,317,402 A * 3/1982 McPherson, Sr. ..... 84/291
6,046,392 A * 4/2000 Saul ..... 84/291

* cited by examiner

*Primary Examiner*—Jeffrey Donels
*Assistant Examiner*—Jianchun Qin

(57) ABSTRACT

An improved hollow-bodied stringed instrument body having a substantially free edge in the lower bout which reduces the coupling of the resonances of the front plate, back plate, and enclosed volume of air. A selected number of holes of a selected shape create a substantially free edge in the lower bout of the front plate. This substantially free edge reduces the large-amplitude displacement of these plates that occurs due to low frequency resonance coupling. Placement of the free edge allows high frequency resonance of the front plate, which is not due to coupling, to contribute to the tone of the instrument. Reducing the large-amplitude displacement of the plates reduces bass-heavy tone and feedback.

3 Claims, 2 Drawing Sheets

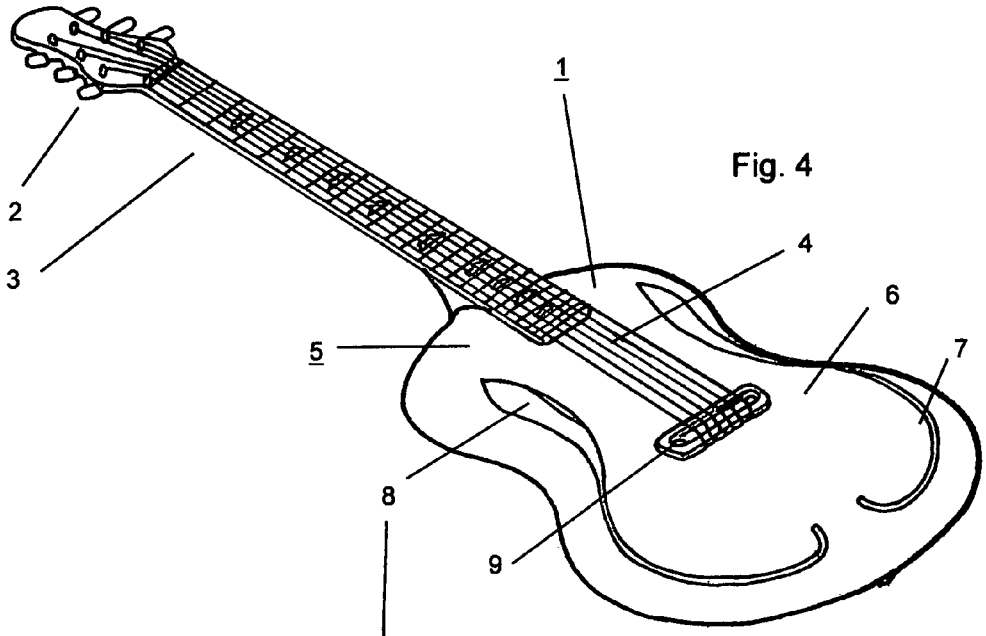
Fig. 4
Fig. 3
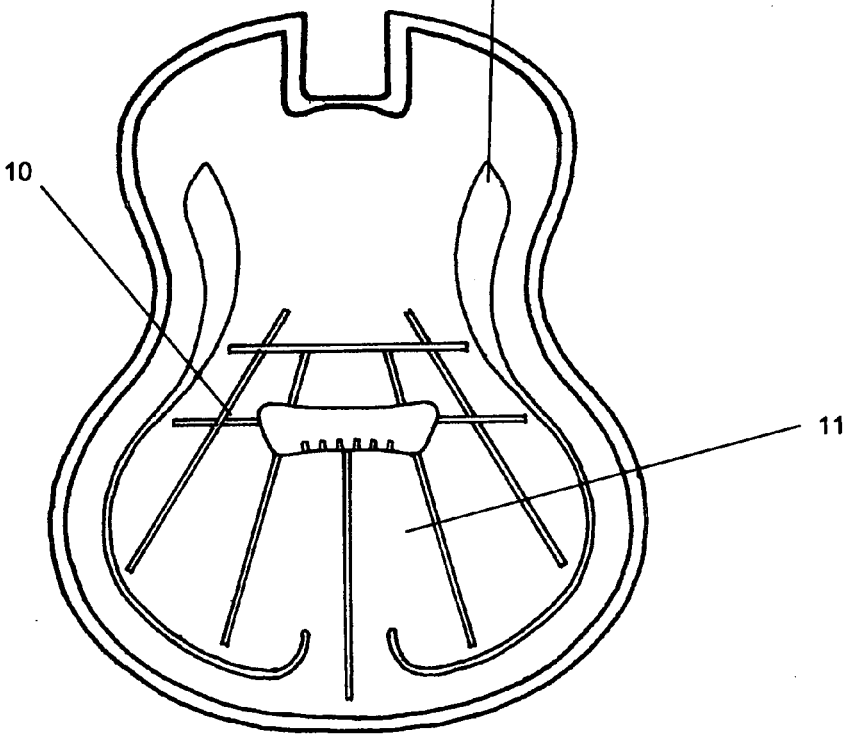

STRINGED INSTRUMENT CONSTRUCTION

CROSS-REFERENCE TO RELATED APPLICATIONS

Not Applicable

FEDERALLY SPONSORED RESEARCH

Not Applicable

JOINT RESEARCH AGREEMENT

Not Applicable

INCORPORATION-BY-REFERENCE OF MATERIAL SUBMITTED ON COMPACT DISC

Not Applicable

BACKGROUND OF THE INVENTION

Field of the Invention

This invention relates to hollow-bodied stringed instruments and, more particularly, to a new and improved body construction for such instruments.

BRIEF SUMMARY OF THE INVENTION

Coupling of resonances of the front plate, back plate, and enclosed volume of air in hollow-bodied stringed instruments is ultimately responsible for such undesirable effects as bass-heavy tone and feedback. Yet, resonance is desirable because it provides the characteristic sound of hollow-bodied stringed instruments. Still, certain resonances are particularly troublesome. For example, it is low frequency resonance that is most responsible for bass-heavy tone and feedback in hollow-bodied guitars. The frequency of these offending resonances varies with guitar size but they are typically around 100 and 200 Hertz in a standard guitar.

Whether the low frequency resonance is that of the enclosed volume of air that is then communicated to the front and back plates or a coincidence of resonances of the respective plates, the coupling results in large amplitude displacement of these elements. The body, which essentially pumps air through the soundhole at low frequencies, thus naturally amplifies these notes resulting in bass-heavy tone. When a pickup is used, feedback tends to occur at these notes.

High frequency resonance, which is due not to coupling but to the resonance of one or the other of the plates, is not nearly so problematic and should be preserved as much as possible. Needed is a body for a hollow-bodied stringed instrument that simply and mechanically attenuates low frequency resonance while allowing high frequency resonance to contribute to the tone of the instrument.

This embodiment of the present invention alleviates to a great extent the aforementioned problems by providing a hollow-bodied stringed instrument body wherein at least one plate has at least one substantially free edge. This unique structure exploits the fundamental difference between high and low frequency resonances in hollow-bodied stringed instruments. The free edge attenuates low frequency coupling of the plate with the opposing plate and the enclosed volume of air while the portion of the body that opposes string tension provides mass, area, and stiffness to allow for high frequency resonance resulting in retention of the characteristic sound of a hollow-bodied stringed instrument.

The goal of prior art acoustic guitar design was to maximize resonance in order to maximize loudness. The tone imbalance in the form of bass-heavy tone that this created when the guitar was played acoustically was inevitable. The feedback that such tone imbalance caused when amplification was used was dealt with by the application of additional technology. In contrast to the goal of the prior art, the goal of this embodiment of the current invention is to balance tone by selectively reducing resonance. Such an approach has never been taken in the prior art.

Maximizing loudness requires leaving the lower bout of each plate intact since the lower bouts are the largest parts of each plate and each moves as a unit during low frequency resonance. Single soundholes in guitars are located at or above the division between the upper and lower bouts. While violin-style f-holes and the various other paired hole arrangements may extend slightly into the lower bout, no prior art instrument featured a substantially free edge in the lower bout.

This body for a hollow-bodied stringed instrument reduces bass-heavy tone mechanically. This is especially useful for large-bodied acoustic guitars where bass notes dominate when played acoustically. When used with a magnetic pickup, this reduced coupling reduces pickup motion and associated feedback thus making it ideally suited for application to hollow-bodied electric guitars as well.

When used with a pickup designed for acoustic instruments, it also reduces bass-heavy tone mechanically rather than requiring the electronic modification of tone often seen today. The choice of acoustic pickup need not hinge on electronic bass response modification or sensitivity to body vibration, both limiting factors in the prior art.

When used with a pickup designed for acoustic instruments, feedback is prevented structurally thus eliminating the common practice of deleting offending frequencies electronically with a notch filter. No frequencies are deleted; thus, no adjustment is required on the part of the musician to find and delete offending frequencies that might change in different environments. Low frequency resonance involves coupling and coupling is attenuated by the structure.

Every note is available to the musician and the tone of the instrument is controlled solely by the musician and accurately reproduced through the amplifier with substantially less feedback than in previous hollow-bodied instruments.

Varying the degree to which the free edge is free allows the instrument maker to fine tune the loudness of the bass notes relative to the higher notes when the instrument is played acoustically. When a pickup is used such flexibility translates into control over feedback.

Further objects and advantages of this embodiment of the invention will become apparent from a consideration of the drawings and ensuing description.

SUMMARY

The above problems and others are at least partially solved and the above purposes and others realized in this new and improved body for a hollow-bodied stringed instrument including at least one plate having at least one substantially free edge. This arrangement reduces the coupling between the resonances of the plates and the enclosed volume of air at low frequencies while allowing high frequency resonance to contribute to the tone of the instrument.

BRIEF DESCRIPTION OF THE SEVERAL VIEWS OF THE DRAWINGS

Referring to the drawings:

FIG. 3 is a view of the inside of the front plate of the guitar showing the ribs.

FIG. 4 is an isometric view of a guitar with a body using curved shells and having no conventional side wall wherein the front plate includes the free edge.

DRAWINGS

Reference Numerals

Figures 1, 2:
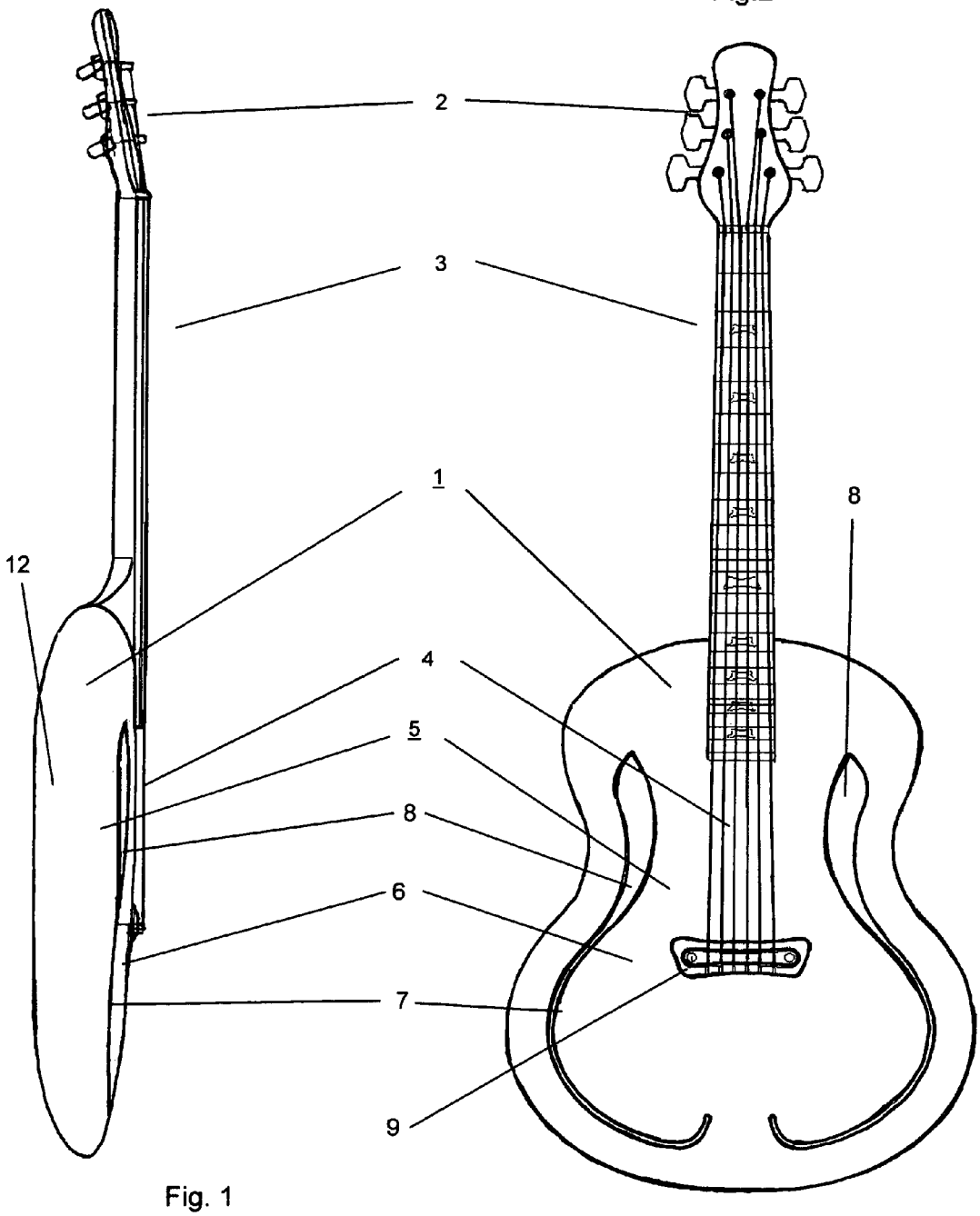
FIG. 1 is a side view of a guitar with a body using curved shells and having no conventional side wall wherein the front plate includes the free edge.
FIG. 2 is a front view of a guitar with a body using curved shells and having no conventional side wall wherein the front plate includes the free edge.

1. guitar
2. head
3. neck
4. strings
5. body
6. front plate
7. free edge of front plate
8. hole
9. bridge
10. ribs
11. inside surface of front plate
12. back plate

DETAILED DESCRIPTION OF THE INVENTION

In its preferred embodiment the present body is illustrated in FIGS. 1 to 4 as applied to a guitar body with curved front and back plates and no conventional side wall wherein the curved top plate has the substantially free edge; it should be readily apparent, however, that in other embodiments the substantially free edge could alternatively be in the curved back plate or both plates and that the present invention is equally applicable to all hollow-bodied stringed instruments including flat-topped guitars and arched-topped guitars both with conventional side walls.

FIGS. 1 to 4 show a hollow-bodied stringed instrument comprising a guitar 1 having a head 2, neck 3, strings 4, and guitar body 5. The guitar body 5 is a soundbox in the form of a hollow body. The guitar body 5 includes front plate 6. Front plate 6 has substantially free edge 7 due to a selected number of holes 8. The substantially free edge 7 of front plate 6 preferably follows the shape of the outer edge of front plate 6. Front plate 6 is joined to a back plate 12 adhesively to form a guitar body 5. Bridge 9 is carried by front plate 6. The strings 4 extend from the head 2 along the neck 3 to the bridge 9. In the embodiment depicted in FIGS. 1 to 4, the guitar body 5 is made of wood. According to other embodiments, the guitar body 5 may be made of plastic, graphite or other appropriate materials.

In the embodiment depicted in FIGS. 1 to 4, the number of holes 8 is two and they are elongated. The two holes 8 in the front plate 6 are substantially located on opposite sides of the plurality of strings 4. The holes 8 are a generally uniform distance from the periphery of the front plate 6 and generally converge to within the length of the bridge 9 substantially between the bridge 9 and the end of the front plate 6 situated nearest said bridge 9. The holes 8 approach most closely substantially between the bridge 9 and the end of the front plate 6 situated nearest said bridge 9. The elongated holes 8 generally converge between the widest portion of the front plate 6 and the end of the front plate 6 situated nearest said bridge 9. The holes can never completely converge since that would result in one hole and no support against string tension from the periphery of the lower bout. According to other embodiments, the number and shapes of holes may vary. In the preferred embodiment, ribs 10 are transversely attached to the inside surface 11 of the top plate 6 and the extension of the ribs 10 is limited by holes 8 as in FIG. 3. According to other embodiments, other means of support may be used.

OPERATION OF PREFERRED EMBODIMENT

The relatively rigid peripheral portion of front plate 6 is adhesively connected to the back plate 12 and acts as a framework supporting the less rigid central portion of front plate 6 against string tension. Energy from one or more plucked strings is transmitted through the bridge 9 to the front plate 6 where it spreads in all directions in a deforming wave that causes front plate 6 to drive the surrounding air.

Generally, when the driving frequency is a resonant frequency common to front and back plates this results in large displacement of these elements and a natural amplification of such notes by the guitar body. However, in the current embodiment of the invention the substantially free edge 7 of the front plate 6 alters the physical characteristics of the front plate 6 to minimize the coincidence of resonant frequencies between front plate 6 and back plate 12 even if these components are made from the same material and have nearly identical dimensions. The deforming wave cannot advance when encountering the free edge 7 thus the boundary condition of much of the front plate 6 is effectively changed to free even though the peripheral portion is firmly attached to the back plate 12.

Generally, when the driving frequency is a resonant frequency of the enclosed volume of air the result is alternating expansion and contraction of the entire body. However, in the current embodiment of the invention the substantially free edge 7 of the front plate 6 alters the physical characteristics of the front plate 6 to minimize this characteristic breathing motion. In the prior art this breathing motion is so problematic that when an acoustic guitar is fitted with a pickup designed for such guitars and played through an amplifier, or simply played acoustically into a microphone, some sort of plug is often placed in the soundhole or the top plate is significantly stiffened to prevent feedback due to this motion. In the current invention no such measures are necessary. The enclosed volume of air can be exposed to resonant frequencies because the breathing motion is minimized by the substantially free edge.

The pattern and number of holes 8 creating the free edge 7 of the front plate 6 for the preferred embodiment were chosen to create a free edge in substantially all of the lower bout. The free edge 7 defines a large area for the center portion of the front plate 6 by being located a generally uniform and short distance from the outer edge of front plate 6. The large area of the front plate 6 which carries the bridge 9 and has ribs 10 providing stiffness allows the front plate 6 to act as a resonant front plate allowing this to color the tone of the instrument. These high frequency resonances are not dependent on coupling between the plates or resonance of the enclosed volume of air.

While two holes 8 creating a substantially free edge 7 on front plate 6 are shown and discussed, it is possible to vary the number and shapes of holes to adjust the following parameters: the extent to which the substantially free edge is free; the area of the bridge-supporting portion of the front plate; the extent to which the lower bout contains a free edge; the degree to which the free edge is symmetric about the longitudinal axis of the front plate.

In the embodiment depicted in FIGS. 1 to 4, the extent to which the lower bout contains a free edge is determined by the holes 8. The holes 8 define a continuous portion of the front plate 6 extending between the closest approach of the holes 8 in the lower bout. This radial continuity from the bridge 9 to the periphery of the front plate 6 provides support against string tension. The rest of the lower bout has a free edge 8. The deforming wave radiating from the bridge 9 can only reach the periphery of the lower bout of the front plate 6 along this continuous path. The width of this continuity is variable. The preferred embodiment uses a width that gives a large degree of reduction of low frequency resonance while maintaining adequate support against string tension.

In the embodiment depicted in FIGS. 1 to 4, the portion of each hole that extends into the lower bout is made narrow in an attempt to create a free edge while minimizing the increase in total airflow through all holes.

While there is shown and described the present preferred embodiment of the invention, it is to be distinctly understood that this invention is not limited thereto but may be variously embodied to practice within the scope of the following claims.

I claim:

1. A hollow-bodied guitar, comprising:

a front plate;

a back plate connecting to said front plate;

a bridge connecting to said front plate;

a neck connecting to said front plate and said back plate;

a head connecting to said neck;

a plurality of strings extending between said bridge and said head; and two holes in said front plate being substantially located on opposite sides of said plurality of strings, said holes being a generally uniform distance from the periphery of said front plate, said holes generally converging to within the length of said bridge substantially between said bridge and the end of said front plate situated nearest said bridge;

whereby a substantially free edge is created in the lower bout and coupling between said front plate and said back plate is reduced.

2. The instrument of claim 1 wherein said front plate includes a plurality of ribs connecting to the inside of said front plate.

3. A hollow-bodied guitar, comprising:

a front plate;

a back plate connecting to said front plate;

a bridge connecting to said front plate;

a neck connecting to said front plate and said back plate;

a head connecting to said neck;

a plurality of strings extending between said bridge and said head; and two holes in said front plate being substantially located on opposite sides of said plurality of strings, said holes approaching most closely substantially between said bridge and the end of said front plate situated nearest said bridge;

whereby a substantially free edge is created in the lower bout and coupling between said front plate and said back plate is reduced.

* * * * *